US005589924A

United States Patent [19]

Yano et al.

[11] Patent Number: 5,589,924

[45] Date of Patent: Dec. 31, 1996

[54] ELECTROPHOTOGRAPHIC IMAGE FORMING SYSTEM

[75] Inventors: Hideyuki Yano, Yokohama; Koichi Tanigawa, Tokyo; Akihiko Takeuchi, Yokohama; Hiroshi Sasame, Yokohama; Yasumasa Otsuka, Yokohama; Hiroto Hasegawa, Yokohama; Hideo Nanatani; Kazuaki Ono, both of Tokyo, all of Japan

[73] Assignee: Canon Kabushiki Kaisha, Tokyo, Japan

[21] Appl. No.: 526,281

[22] Filed: Sep. 11, 1995

Related U.S. Application Data

[63] Continuation of Ser. No. 145,588, Nov. 4, 1993, which is a continuation of Ser. No. 840,536, Feb. 25, 1992, Pat. No. 5,321,482.

[30] Foreign Application Priority Data

| | | | |
|---|---|---|---|
| Mar. 1, 1991 | [JP] | Japan | 3-36168 |
| Feb. 12, 1992 | [JP] | Japan | 4-25224 |

[51] Int. Cl.[6] ..... G03G 21/00

[52] U.S. Cl. ..... 399/350; 399/346

[58] Field of Search ..... 355/210, 211, 355/219, 299, 296, 200; 361/225; 252/9; 118/652

[56] References Cited

U.S. PATENT DOCUMENTS

| | | | |
|---|---|---|---|
| 3,552,850 | 1/1971 | Royka et al. | 355/299 |
| 4,158,498 | 6/1979 | Ohmori | 355/299 |
| 4,519,698 | 5/1985 | Kohyama et al. | 355/299 |
| 4,757,349 | 7/1988 | Toshimitsu et al. | 355/299 |
| 4,851,960 | 7/1989 | Nakamura et al. | 361/225 |
| 4,970,560 | 11/1990 | Lindblad et al. | 355/299 |
| 5,060,014 | 10/1991 | Adachi et al. | 355/211 |
| 5,126,913 | 6/1992 | Araya et al. | 361/225 |
| 5,145,724 | 9/1992 | Yanai | 427/430.1 |
| 5,177,537 | 1/1993 | Okano et al. | 355/259 |
| 5,321,482 | 6/1994 | Yano et al. | 355/299 |

FOREIGN PATENT DOCUMENTS

| | | |
|---|---|---|
| 0384354 | 8/1990 | European Pat. Off. . |
| 0460658 | 12/1991 | European Pat. Off. . |
| 58-0086971 | 11/1983 | Japan . |
| 2-219082 | 8/1990 | Japan . |
| 2-287483 | 11/1990 | Japan . |

OTHER PUBLICATIONS

European Search Report.

Xerox Disclosure Journal, vol. 12, No. 5 (Sep./Oct. 1987) at pp. 241–242.

*Primary Examiner*—William J. Royer

*Attorney, Agent, or Firm*—Fitzpatrick, Cella, Harper & Scinto

[57] ABSTRACT

An image forming system for forming an image on a recording sheet, including a rotatable image bearing member, a cleaning member contacting the image bearing member to remove toner remaining on the image bearing member, and charger means contacting the image bearing member and disposed at a downstream side of the cleaning member in a direction of movement of the image bearing member. Lubricant having a low resistance is painted on a contacting portion of the cleaning member between the image bearing member and the cleaning member.

22 Claims, 4 Drawing Sheets

ELECTROPHOTOGRAPHIC IMAGE FORMING SYSTEM

This application is a continuation of application No. 08/145,588 filed Nov. 4, 1993, which is a continuation of application No. 07/840,536 filed Feb. 25, 1992 (now U.S. Pat. No. 5,321,482 issued Jun. 14, 1994).

BACKGROUND OF THE INVENTION

1. Field of the Invention

The present invention relates to an image forming system for forming an image on a recording sheet, and a process cartridge.

2. Related Background Art

In the past, in an electrophotographic system (as an example of image forming system), a corona charger was used as a charger means. However, the corona charger has a drawback in that not only does it require a high voltage but also it requires a cleaning means for the corona wire.

To the contrary, charger means of a contact type using a conductive roller, conductive blade and the like have recently been put to practical use. It has been ascertained that such charger means provide an advantage in that they do not require either a large electric power source with a low pressure process or special cleaning means. In such charging means of contact type, the charging potential is generated on an object to be charged by contacting a conductive charger member with the object to be charged and by applying a voltage so as to cause a discharge in a gap between the charger member and the object to be charged. The object can be uniformly charged by applying to it a voltage obtained by overlapping an AC voltage to the DC voltage corresponding to the charging potential.

More specifically, as disclosed in U.S. Pat. No. 4,851,950, the object to be charged can be uniformly charged by producing an alternating electric field having a peak-to-peak voltage more than twice that of the charging start voltage upon application of the DC voltage to the object to be charged, between the charger member and the object to be charged.

Next, conventional cleaning means will be explained. In the cleaning means of the electropotographic system, generally the non-transferred residual toner remaining on a photosensitive member (image bearing member) is scraped from the photosensitive member by rotatingly contacting a cleaning roller with the photosensitive member or by abutting a cleaning blade against the photosensitive member. Particularly, in electrophotographic systems using process cartridges, in many cases, a cleaning blade made of urethane rubber is urged e.g., the photosensitive member in a counter direction e.g., opposite to a rotating direction of the photosensitive member, in consideration of the simple construction and inexpensiveness.

However, when a cleaning blade is used, if the friction force between the blade and the photosensitive member becomes great, the blade will often be turned over to cause a so-called "blade turn-up". When toner remains at an edge of the blade, the blade is seldom turned over because the toner acts as lubricant. However during the initial operating condition of the electrophotographic system and(or) process cartridge, since the toner does not exist at the blade edge, blade turn-up will frequency occur.

To avoid this, in the past, the friction force between the photosensitive member and the cleaning blade was reduced by applying powder to the edge of the cleaning blade at the initiation of operation of the electrophotographic system and(or) process cartridge. Such powder must have the properties that it is not harmful or poisonous, that it has a particle diameter effective to prevent blade turn-up, that it can easily be dispersed in the solvent, and that it has excellent solvent resistance. Thus, a powder comprised of PVDF (polyvinylidene fluoride) having the chemical equation of "$-(CH_2CF_2)_n-$", such as, for example, "KYNAR", "FORAFLON", (both Trade Mark) was mainly used. Although a PVDF has the particle diameter of about 0.1–0.2 μm, the secondary particle diameter thereof becomes 20–50 μm when aggregated, and, even when ethyl alcohol is used as the solvent, it is well dispersed in the solvent and has a good painting ability and is not dissolved in the ethyl alcohol. Thus, the PVDF was widely used as the painting or coating material for the cleaning blade.

When the PVDF particles are applied to the cleaning blade abutting against the image bearing member in the charger means of contacting type, the contacting charger member must be arranged at a downstream side of the cleaning blade in a shifting direction of the photosensitive member, in consideration of the construction of the electrophotographic system. Thus, the PVDF particles passed through or excessively applied to the cleaning blade are dropped on the photosensitive member, with the result that it is feared that the dropped particles are adhered to the downstream contacting charger member. In particular, since the PVDF particles have a high aggregativity and tend to adhere to nylon resin widely used as the surface coating material for the contacting charger member, once the PVDF particles were adhered to the surface of the contacting charger member there arose a problem in that the particles were difficult to remove even by the sliding contact between the charger member and the photosensitive member. Further, since the PVDF material is a high resistive material having an inherent volume resistance value of $10^{12}$ Ω cm or more, if such material is adhered to the surface of the contacting charger member, it is feared that the surface portions of the photosensitive member contacting with the surface of the charger member to which the material is adhered cannot be sufficiently charged, thus resulting in the poor charging.

The above drawbacks inevitably occur in systems using a contacting charger member and a cleaning blade contacting the image bearing member. Now, an additional cleaning means may be provided for removing the PVDF particles from the contacting charger member. In this case, however, it may be feared that the contacting charger member is damaged due to the sliding contact between it and the cleaning means and the whole system will become more expensive.

SUMMARY OF THE INVENTION

An object of the present invention is to provide a process cartridge and an image forming system which can improve the image quality.

Another object of the present invention is to provide a process cartridge and an image forming system which can maintain the high image quality.

A further object of the present invention is to provide a process cartridge and an image forming system which can uniformly charge a surface of a photosensitive member.

A still further object of the present invention is to provide a process cartridge and an image forming system each of which includes a contacting charger means and a cleaning means contacting an image bearing member and which can maintain a condition that the image bearing member can be uniformly charged.

A further object of the present invention is to provide a process cartridge and an image forming system which can maintain the cleaning ability for cleaning an image bearing member.

An other object of the present invention is to provide a process cartridge and an image forming system each of which includes a rotatable image bearing member, a cleaning member contacting the image bearing member and adapted to remove the residual toner from the image bearing member, and a charger means disposed at a downstream side of the cleaning member and contacting the image bearing member, and wherein lubricant having low resistivity is applied to a contacting portion between the image bearing member and the cleaning member.

DETAILED DESCRIPTION OF THE PREFERRED EMBODIMENTS

Figure 1:
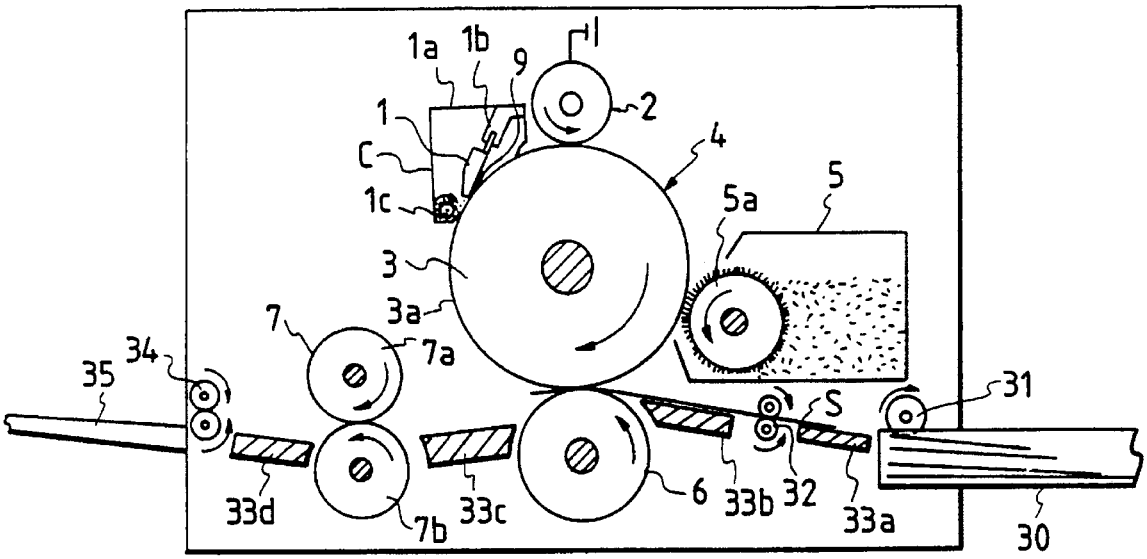
FIG. 1 is an elevational sectional view of an image forming system according to a preferred embodiment of the present invention.

FIG. 1 is an elevational sectional view of an electrophotographic image forming system (for example, a printer, copying machine and the like) to which the present invention is applied. This system will now be explained.

A photosensitive drum 3 acting as an image bearing member is shifted or rotated in a direction shown by the arrow. An electrophotographic photosensitive surface 3*a* of the drum 3 is charged by a contacting charger roller 2 acting as a charger means. The charged surface of the photosensitive drum 3 is then exposed by image information light 4 (for example, light reflected from an original in the case of the copying machine, or, a laser beam corresponding to a signal from a host computer in the case of the printer) to form an electrostatic latent image thereon. The latent image formed on the drum is developed by a developing sleeve 5*a* of a developing device 5 to be visualized as a toner image. The toner image formed on the photosensitive surface 3*a* is transferred onto a recording sheet S by a transfer roller 6 acting as a transfer means. The non—fused toner image transferred to the recording sheet S is then fixed onto the sheet with heat by a fixing device 7 (including a heat roller 7*a* and a pressure roller 7*b*), so that a permanent image is formed on the recording sheet S. On the Other hand, non-transferred residual toner remaining on the photosensitive surface 3*a* is removed from the drum by a cleaning blade 1 acting as a cleaning member and contacting the photosensitive surface 3*a*, thus preparing for the next image formation. The cleaning blade 1 has a rectangular free end having a thickness smaller than that of a base end (retained by a holder 1*b*) of the blade.

Incidentally, a cassette 30 containing a plurality of recording sheets therein is removably mounted on the image forming system. A sheet supply roller 31 serves to feed out the recording sheet from the cassette 30. The fed recording sheet is sent to a pair of register rollers 32 which serve to feed the sheet in registration with the image formed on the photosensitive surface 3*a* of the drum. Guides 33*a*—33*d* serve to guide the recording sheet in a predetermined direction. A pair of ejection rollers 34 serve to eject the recording sheet on which the image was recorded onto a tray 35.

Figure 3:
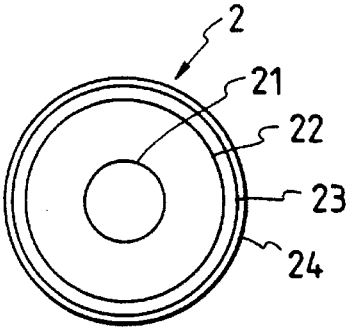
FIG. 3 is a cross-sectional view of a charger roller of FIG. 1.

Next, the charger roller 2 will be fully explained. As shown in FIG. 3, the charger roller 2 has a diameter of 12 mm and comprises a metal core 21 having a diameter of 6 mm and three functional layers 22–24 coating the metal core.

Explaining each of these layers, a first or innermost layer 22 is made of conductive material obtained by dispersing conductive carbon powders in butadiene rubber and functions to give the roller the softness sufficient to maintain a uniform nip between the photosensitive drum and the charger roller. More particularly, it was found that the hardness of such layer having the thickness 3 mm and coated on the metal core was 55° (consequent upon the measurement test wherein the weight of 1 Kg was added to the rubber roller by means of the Asker C hardness test meter).

A second or intermediate layer 23 is a resistive layer the resistance of which was controlled by dispersing the conductive carbon powders in urethane rubber having a thickness of 200 μm. It was found that the actual total resistance value of the first and second layers was in the order of $10^5$ Ω (consequent to the measurement test wherein a metallic tape having a width of 1 cm was wrapped around the second layer and the resistance value was measured between the metallic tape and the metal core).

A third or outermost layer 24 is a coating layer having a thickness of about 5 μm and made of nylon resin. This layer is provided for preventing the bleeding of plasticizer from the inner rubber and urethane layers. However, since nylon resin alone leads to an increase in the resistance value under low temperature and low humidity circumstances to cause poor charging, a conductive filler was dispersed in the nylon resin. Incidentally, the volume resistance value of this outermost layer was normally $10^7$–$10^9$ Ω cm.

The photosensitive surface 3*a* uniformly charged with the voltage of −700 V by the charger roller so formed is then exposed by a semi-conductor laser beam 4 modulated in intensity in response to the image signal. The electric potential of the charged portion of the photosensitive surface is changed to about −150 V. The latent image so formed is then visualized by the developing device 5. The developing device 5 performs inversion development with a one-component negative toner. The developing method was the jamping developing method. Now, a gap or clearance of about 200 μm–800 μm is set between the peripheral surface of the developing sleeve 5*a* and the photosensitive surface 3*a*.

The toner image formed on the low electric potential portion of the photosensitive surface 3*a* by means of the developing device 5 is then transferred onto the recording sheet S by the transfer roller 6 to which the high voltage of 2 KV is applied. The toner image transferred to the recording sheet S is fixed to the sheet with heat by means of the fixing roller 7, and then, the recording sheet is ejected out of the image forming system. In this way, one cycle of the image formation is finished.

On the other hand, as mentioned above, the residual toner (not transferred to the recording sheet S) remaining on the photosensitive surface 3*a* is removed from the photosensitive surface 3*a* by means of the downstream cleaning blade 1 and is collected into a cleaning container 1*a*. The blade holder 1*b* serves to retain the cleaning blade (cleaning member) 1. Incidentally, a screw 1*c* disposed within the cleaning container serves to convey the collected toner to a reservoir portion (not shown).

As will be described later, in a preferred embodiment, the above-mentioned charger element, developing element and cleaning element are constituted as a unit or process cartridge to facilitate the maintenance of the image forming system (printer and the like). In this respect, a chip blade made of urethane rubber as shown in FIG. 4 is used as the cleaning member to make the cartridge simpler and cheaper.

Figure 4:
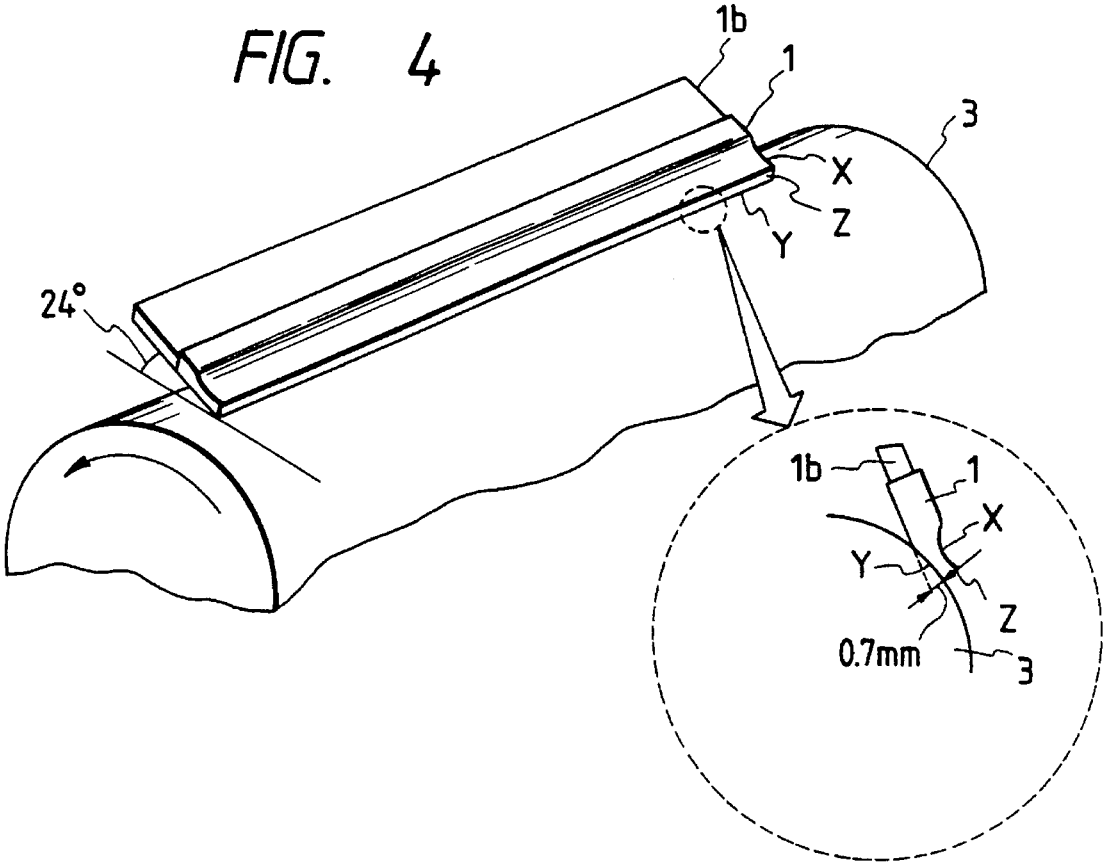
FIG. 4 is a perspective view of the cleaning member of FIG. 1.

As shown in FIG. 4, the chip blade-or cleaning blade is set so that an abutting angle of the blade against the photosensitive surface 3*a* is 24°, a penetrating amount of the blade to the photosensitive surface 3*a* is 0.7 mm and a line pressure of the blade is 35 g/cm. By setting the cleaning blade as mentioned above, it is possible to prevent poor cleaning and blade turn-up during the feeding of the recording sheet.

Incidentally, during the feeding of the recording sheet, since the toner remains at an edge of the cleaning blade 1 and acts as lubricant, blade turn-up seldom occurs; however, at an initial operating condition that the toner does not exist at the blade edge, since the coefficient of friction between the cleaning blade 1 and the photosensitive surface 3*a* is great, the probability of occurrence of blade turn-up will be increased.

Thus, in the illustrated embodiment, low resistive lubricant 9 having a relatively low resistance value is applied to or painted on an abutting portion between the photosensitive surface 3*a* and the cleaning member (cleaning blade) 1. The low resistive lubricant may comprise graphite fluoride particles having the chemical equation of "—$(CH)_n$—" ("CEFBON" trade mark, sold by Central Glass Co., Ltd. in Japan), ultrafine acrylic powder, or fine or pulverized styrene powder, which have a volume resistance value of about $10^{10}$ Ω cm smaller than that of the PVDF material.

In this way, by using the low resistive lubricant it is possible to prevent blade turn-up and to suppress poor charging of the photosensitive surface 3*a* even if the lubricant is adhered to the surface of the charger roller, thus prevented the formation of black dots on the white background in the inversion developing method.

Incidentally, there is no problem as long as the volume resistance value of the low resistive lubricant is $10^5$–$10^{11}$ Ωcm; but, preferably, the volume resistance value of the low resistive lubricant is more than 1/100 of that of the outermost layer of the charger roller. If the volume resistance value of the lubricant is less than $10^5$ Ωcm then when the lubricant is dropped from the edge of the cleaning blade to reach, for example, between the charger roller and the photosensitive member or between the developing sleeve and the photosensitive member, it is feared that abnormal discharging (leak) occurs to cause deterioration of the image. On the other hand, if the volume resistance value of the lubricant is more than $10^{12}$ Ωcm, as mentioned above, it is feared that poor discharging occurs to cause deterioration of the image.

Now, the graphite fluoride particles ("CEFBON CMA" trade mark) used as the low resistive lubricant in the illustrated embodiment will be explained.

The CEFBON CMA has an average particle diameter of about 2 μm and a low aggregativity and has the property that it is difficult to adhere it to the nylon resin used as the surface protecting layer of the contacting charger means. Further, if the CEFBON CMA is adhered to the nylon resin, it is easily removed from the resin by the sliding contact between the charger member and the photosensitive member. In this case, although white dots may be produced on a black image for the initial several recording sheets, when further sheets are passed through the system, the white dots will disappear from the black image. Further, since the volume resistance value of the CEFBON CMA is low such as $10^{10}$ Ωcm, if the CEFBON CMA is adhered to the surface of the charger roller, poor charging hardly occur, and thus, black dots hardly appear on a white image.

Now, the difference between the PVDF particles (KYNAR) and the graphite fluoride particles (CEFBON CMA) when they are painted on the cleaning blade 1 attached to the system as shown in FIG. 4 will be explained.

Figure 2:
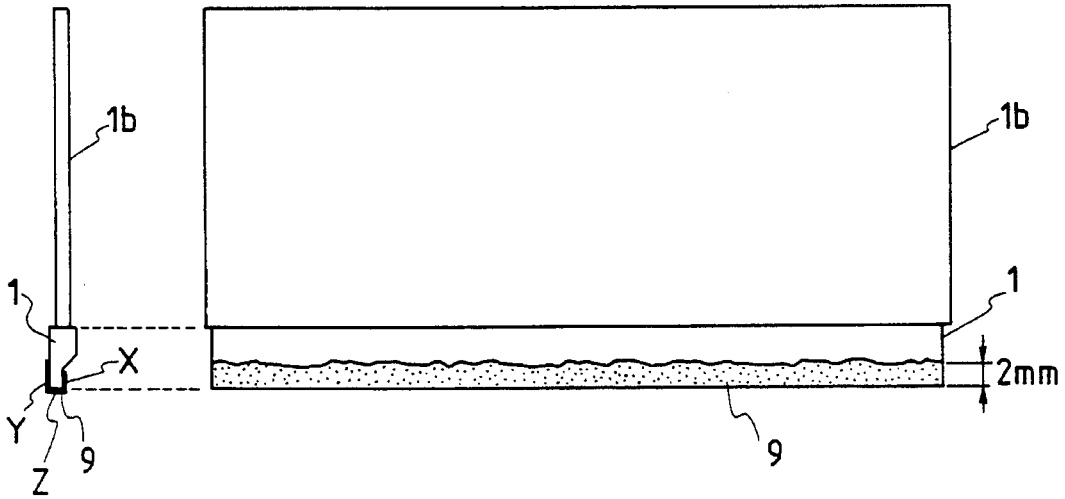
FIG. 2 is a plan view and a side view of the cleaning member of FIG. 1.

Both particles were painted on the cleaning blade 1 in such a manner that they were dispersed into the ethyl alcohol with 10% by weight and were painted on the blade edge with a width of about 2 mm as shown in FIG. 2. That is to say, they were painted on both opposing flat surfaces X and Y and a flat end surface Z (connecting the opposing surfaces X, Y) of the edge portion of the cleaning blade 1.

Incidentally, the electrophotographic printer used in the test had a process speed of 100 mm/sec and was constructed as shown in FIG. 1. An OPC drum having a diameter of 30 mm was used as the photosensitive member 3*a*. Further, the charger roller 2 having a diameter of 12 mm was urged against the photosensitive member 3*a* with the total pressure of 9.8N by a spring bias force and was rotatingly driven by the rotation of the photosensitive member 3*a*. The high voltage obtained by overlapping a constant-current controlled sine wave with a DC voltage of −700 V corresponding to the desired photosensitive charging potential Vd was applied to the charger roller 2. In practice, since the constant-current value was controlled with 600 μA, the peak-to-peak voltage value of the sine wave generated on the charger roller became 2000 V.

The test results are shown in the following Table 1:

TABLE 1

| | Initial | | After 5 sheets | | After 5000 sheets | |
|---|---|---|---|---|---|---|
| | white dot | black dot | white dot | black dot | white dot | black dot |
| KYNAR | X | X | X | X | ○ | Δ |
| CEFBON | X | ○ | Δ | ○ | ○ | ○ |

In the above Table 1, "white dot" means white dot on black copy (or solid copy); "black dot" means black dot on white copy'; "O" indicates that the dot does not appear on the copy or image; "Δ" indicates that the dots appear on the image, but are insignificant, and thus there is no problem; and "X" indicates that the dots effect a bad influence upon the image (No Good).

As shown in the Table 1, it was found that when the CEFBON was used, the black dots on the white image (due to poor charging) resulting in the worst image deterioration for the printer were not produced, and the white dots on the black image (due to the blocking of exposure by the powder particles dropped from the charger member) could be eliminated by passing further several sheets.

In this way, although there was the problem that the painting of the particles on the cleaning blade for preventing the initial blade turn-up may affect the bad influence upon the charging of contact type, this problem can be solved by using the graphite fluoride particles as the painting material as mentioned above.

With the arrangement of the illustrated embodiment, there arose no problem in the corona charging usually used as the conventional charger means, and it was found that the process cartridge and the image forming system according to the present invention were simple, inexpensive and very effective as means for solving the problems inherent to the systems wherein a cleaning blade is used as a cleaning means and a charging of contact type is effected.

Figure 5:
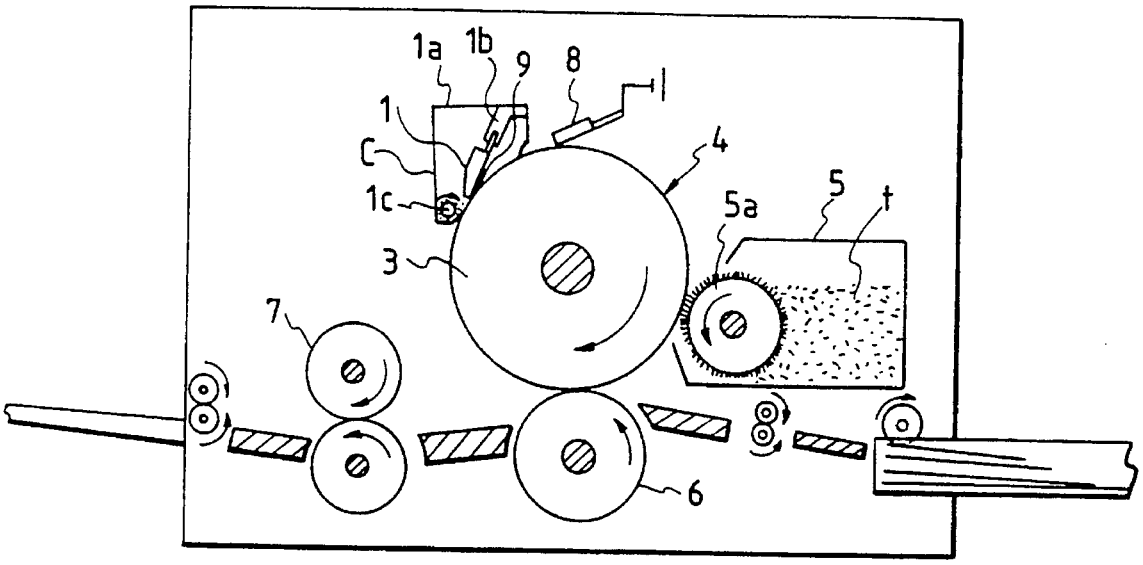
FIG. 5 is an elevational sectional view of an image forming system according to another embodiment of the present invention.

Next, another embodiment of the present invention will be explained with reference to FIG. 5. While the fundamental construction of this embodiment is similar to that of the previous embodiment, in this embodiment, a blade is used as a contacting charger member. A charger blade 8 is more simple and inexpensive, in comparison with the charger roller.

In this embodiment, the charger blade is made of a material substantially the same as that of the charger roller in the previous embodiment. More particularly, the charger blade comprises a base member made of silicone rubber having a thickness of 2 mm and added carbon to make it conductive, a resistance layer covering the base member and made of urethane rubber having a thickness of 200 μm, and a coating layer covering the resistance layer and made of tolidine having a thickness of 5 μm.

The charger blade so formed was incorporated into the electrophotographic printer of FIG. 1 in place of the charger roller 2 and the image was outputted. The charger blade 8 was mounted in such a manner that it was inclined at an angle of 15° with respect to the rotational direction of the photosensitive drum and abutted against the latter in the counter direction. The conditions of the voltage applied to the charger blade were the same as those of the charger roller.

First of all, the PVDF particles (KYNAR) dispersed into the ethyl alcohol with 10% by weight were painted on the cleaning blade, and the image was outputted. Since the PVDF particles were painted, although initial blade turn-up did not occur, a vertical black stripe was produced on the image even from the first copy sheet. Observing the charger blade in this point, a lump of PVDF particles was found at the blade edge, and it was ascertained that the position of the lump on the blade edge corresponded to the position of the vertical black stripe on the image. Thus, it was found that the defect (stripe) of the image was caused by poor charging due to the PVDF particles.

While the vertical stripe became thinner gradually as the number of copies was increased because the PVDF lump became smaller gradually, about the first 100 copies had the defect in the image. Now, the same test was performed under a condition that the graphite fluoride particles ("CEFBPN" CMA" trade mark) having the chemical equation of "—$(CH)_n$—" and dispersed into the solvent (for example, ethyl alcohol or isopropyl alcohol (IPA)) with 10% by weight were painted on the cleaning blade as the lubricant.

Since the CEFBON CMA has low aggregativity, it is hard to lump it together. Thus, even when it was dropped out from the cleaning blade to adhere to the photosensitive member, it was found that poor charging did not occur because the CEFBON CMA particles could be passed through the charger blade due to their smaller particle diameters. Further, even when the lump of the CEFBON CMA particles reached the charger blade, it was found that the charging ability of the charger blade was not reduced because of the low electrical resistance of the CEFBON CMA.

In this way, in systems wherein the charger blade is used, in place of PVDF particles used as the painting material for preventing the initial blade turn-up, by using the graphite fluoride particles having the chemical equation of "—$(CH)_n$—", it is possible to prevent the defect of the image due to the vertical black stripe which was caused by the poor charging because of the lump.

Incidentally, even if the graphite fluoride particles dropped from the cleaning blade 1 and adhered to the transfer roller S, the transferring operation will not be badly affected since the transfer roller has a higher resistance value.

Further, while a cleaning blade was used as the cleaning member in the above embodiments, it should be noted that the above-mentioned charging of contact type can be effected even when a cleaning member which is abutted against the photosensitive member to cause a problem of friction between both members (for example, a cleaning roller abutted against the photosensitive member and rotated in the counter direction ) is used.

Figure 6:
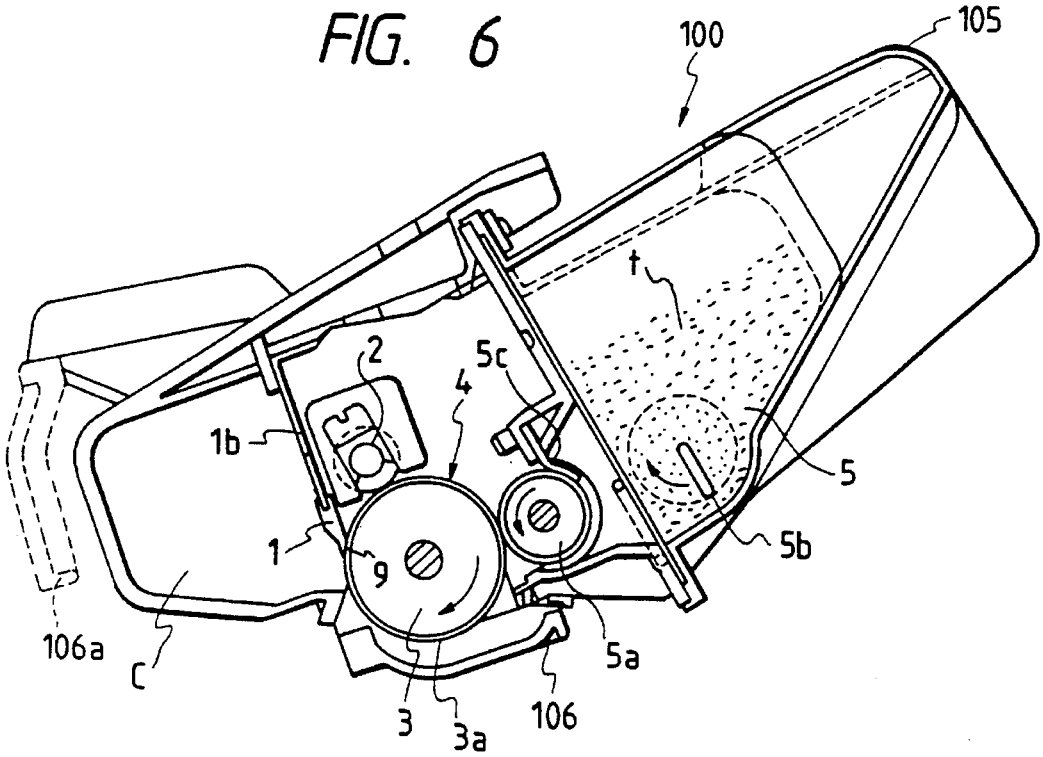
FIG. 6 is an elevational sectional view of a process cartridge to which the present invention is applied.

Next, a process cartridge to which the present invention is applied will be explained with reference to FIG. 6.

Incidentally, the same structural elements as those in the previous embodiments are designated by the same reference numerals and the detailed explanation thereof will be omitted.

A process cartridge 100 according to this embodiment is constituted as a unit (cartridge) wherein a contacting charger roller 2, cleaning device C, developing device 5 and electrophotographic photosensitive member 3 are all incorporated into a frame 105 and which can be removably mounted within an image forming system. Incidentally, the reference numeral **5*b* denotes an agitating blade for conveying the toner t contained within the developing device 5 toward a developing sleeve 5*a*; 5*c* denotes a doctor blade for regulating a thickness of a toner layer around the developing sleeve 5*a*; and 106 denotes a drum shutter for protecting the surface 3*a* of the photosensitive member 3 when the process cartridge 100 is removed from the system. The drum shutter 106 is opened to reach a position 106*a* shown by a phantom line when the process cartridge 100** is mounted within the system, thus not preventing the transferring of the toner image onto the recording sheet.

Figure 7:
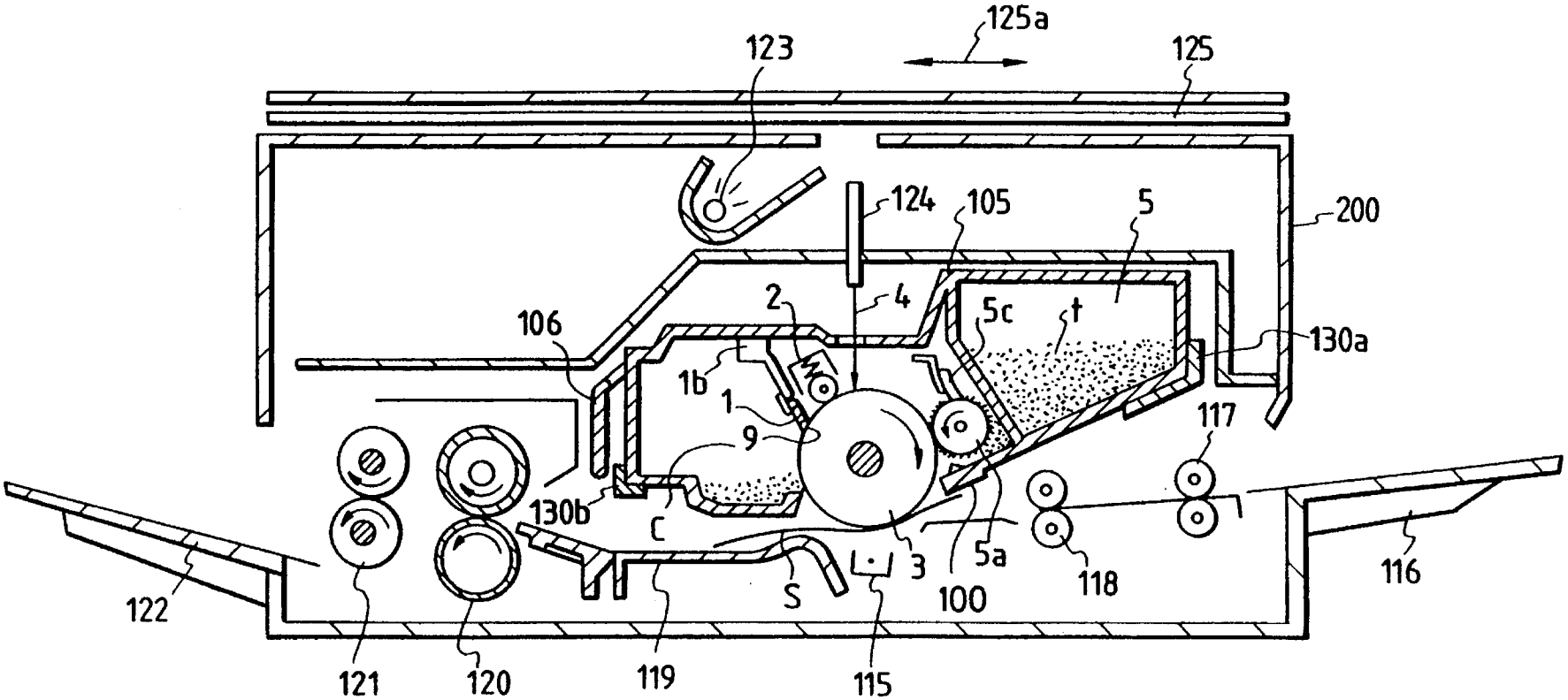
FIG. 7 is an elevational sectional view of an electrophotographic copying machine on which the process cartridge of FIG. 6 can be removably mounted.

Next, an electrophotographic copying machine within which the process cartridge 100 can be mounted will be explained with reference to FIG. 7. Incidentally, FIG. 7 shows a condition that the process cartridge 100 has already been mounted within the copying machine. However, the process cartridge 100 is schematically shown.

As mentioned above, the process cartridge 100 includes a photosensitive drum 3 acting as an image bearing member around which there are arranged process means for forming an image on the photosensitive drum 3, such as a developing device 5, charger 2, cleaning device C and the like. The photosensitive drum 3 and these process means are integrally incorporated into a housing or frame (support member) 105 to form the process cartridge which is removably mountable within a copying machine 200. Incidentally, the reference numerals **130*a* and 130*b* denote cartridge mounting means for removably mounting the cartridge 100**.

Below the photosensitive drum 3 of the cartridge when mounted, the copying machine 200 includes a transfer charger 115. At an upstream side of the transfer charger 115, there are arranged a sheet supply tray 116, sheet supply rollers 117 and a pair of register rollers 118; whereas, at a downstream side of the transfer charger, there are arranged a sheet guide 119, a fixing device 120, ejector rollers 121 and an ejection tray 122.

Further, above the process cartridge 100 when mounted, the copying machine includes a lighting lamp 123 for illuminating an original, and a short focus optical element array 124 for exposing the photosensitive drum 3 by using image light reflected from the original. Further, on the machine 200, there is disposed an original support plate 125 reciprocably shiftable in direction shown by the arrow 125*a*.

When the photosensitive drum 3 uniformly charged is illuminated by the image light from the original rested on the original support plate 125 and lighted by the lamp 123 via the short focus optical element array 124, an electrostatic latent image is formed on the photosensitive drum 3. As the photosensitive drum 3 is rotated, the electrostatic latent image reaches the developing device 5, where it is developed with toner to form a toner image. On the other hand, a recording sheet S is sent from the sheet supply tray 116 to the paired register rollers 118 by the sheet supply rollers 117. The recording sheet then is conveyed between the photosensitive drum 3 and the transfer charger 115 by means of the register rollers in registration with the toner image formed on the drum. In this way, the toner image formed on the photosensitive drum 3 is transferred onto the recording sheet S.

The recording sheet S bearing the transferred toner image thereon is sent to the fixing device 120, where the toner image is permanently fixed to the recording sheet. Thereafter, the recording sheet is ejected on the ejection tray 122 by means of the ejection rollers 121. On the other hand, after the transferring operation, the residual toner remaining on the photosensitive drum 3 is removed by the cleaning blade 1 of the cleaning device C, thus preparing for the next image formation.

In this embodiment, unlike to the aforementioned embodiment, since the toner development is effected at the proper developing system, i.e., charging area, is it possible to prevent deterioration of the image due to white dots on the black copy.

As mentioned above, in the above-mentioned embodiments, since, in place of the PVDF particles having a high resistance, a low resistive lubricant having a low resistance value is painted on the contacting area between the image bearing member and the cleaning member, it is possible to reduce the friction force of the cleaning member and to prevent poor charging of the charger means contacting the image bearing member.

Thus, according to the present invention, it is possible to provide a process cartridge and an image forming system which can maintain high image quality.

What is claimed is:

1. An electrophotographic image forming system for forming an image on a recording sheet, comprising:

a rotatable photosensitive member;

developing means for developing a latent image formed on said photosensitive member;

transfer means for transferring a toner image formed on said photosensitive member onto a recording sheet;

a cleaning blade contacting said photosensitive member to remove toner remaining on said photosensitive member after a transfer operation by said transfer means, a portion of said cleaning blade contacting said photosensitive member being coated with graphite fluoride particles;

a charger member contacting said photosensitive member to charge it, and disposed downstream of said cleaning blade in a direction of rotation of said photosensitive member, between said cleaning blade and said developing means; and conveying means for conveying a recording sheet.

2. An electrophotographic image forming system according to claim 1, wherein said graphite fluoride particles are dispersed into a solvent and then painted on said portion of said cleaning blade.

3. A electrophotographic photosensitive system according to claim 2, wherein said solvent comprises ethyl alcohol.

4. A system according to claim 2, wherein said solvent comprises isopropyl alcohol.

5. An electrophotographic image forming system according to claim 1, wherein said cleaning blade is made of rubber.

6. An electrophotographic image forming system according to claim 1, wherein said charger member is a charger roller including a first layer made conductive by dispersing conductive carbon into butadiene rubber, a second layer surrounding said first layer and obtained by dispersing conductive carbon into urethane rubber, and a third layer surrounding said second layer and obtained by dispersing conductive filler into nylon resin.

7. An electrophotographic image forming system according to claim 1, wherein said graphite fluoride particles have a volume resistance value of $10^5$–$10^{11}$ μm.

8. A process cartridge removably mountable in an electrophotographic image forming system for forming an image on a recording sheet, comprising:

a photosensitive member;

a charger member contacting said photosensitive member to charge said photosensitive member;

developing means for developing a latent image formed on said photosensitive member; and a cleaning blade contacting said photosensitive member to remove any toner remaining on said photosensitive member, wherein a portion of said cleaning blade contacting said photosensitive member is coated with graphite fluoride particles;

said charger member contacting said photosensitive member to charge it, and disposed downstream of said cleaning blade in a direction of rotation of said photosensitive member, between said cleaning blade and said developing means.

9. A process cartridge according to claim 8, wherein said graphite fluoride particles are dispersed in a solvent and painted on said portion of said cleaning blade.

10. A process cartridge according to claim 9, wherein said solvent comprises ethyl alcohol.

11. A process cartridge according to claim 9, wherein said solvent comprises isopropyl alcohol.

12. A process cartridge according to claim 8, wherein said cleaning blade is made of rubber.

13. A process cartridge according to claim 8, wherein said cleaning blade is made of urethane rubber.

14. A process cartridge according to claim 8, wherein said charger member is a charger roller on which a coating layer obtained by dispersing conductive filler into nylon resin is provided.

15. A process cartridge according to claim 8, wherein said charger member is a charger roller including a first layer made conductive by dispersing conductive carbon into butadiene rubber, a second layer surrounding said first layer and obtained by dispersing conductive carbon into urethane rubber, and a third layer surrounding said second layer and obtained by dispersing conductive filler into nylon resin.

16. A process cartridge according to claim 8, further including an openable drum shutter for protecting said photosensitive member.

17. A process cartridge according to claim 8, wherein said graphite fluoride particles have a volume resistance value of $10^5$–$10^{11}$ Ωm.

18. An electrophotographic image forming system for forming an image on a recording sheet, a process cartridge being removably mountable therein, said image forming system comprising:

mounting means for removably mounting a process cartridge including a photosensitive member, a charger member contacting said photosensitive member to charge said photosensitive member, developing means for developing a latent image formed on said photosensitive member, and a cleaning blade contacting said photosensitive member to remove toner remaining on said photosensitive member a portion of said cleaning blade contacting said photosensitive member being coated with graphite fluoride particles, said charger member contacting said photosensitive member to charge it, and being disposed downstream of said cleaning blade in a direction of rotation of said photosensitive member, between said cleaning blade and said developing means; and conveying means for conveying a recording sheet.

19. An electrophotographic image forming system according to claim 18, further including fixing means for fixing a toner image transferred to a recording sheet.

20. An electrophotographic image forming system according to claim 18, wherein said image forming system is a printer.

21. An electrophotographic image forming system according to claim 18, wherein said image forming system is an electrophotographic copying machine.

22. An electrophotographic image forming system according to claim 18, wherein said graphite fluoride particles have a volume resistance value of $10^5$–$10^{11}$ Ωm.

* * * * *

UNITED STATES PATENT AND TRADEMARK OFFICE

CERTIFICATE OF CORRECTION

PATENT NO. : 5,589,924

DATED : December 31, 1996

INVENTOR(S) : HIDEYUKI YANO, ET AL.

It is certified that error appears in the above-indentified patent and that said Letters Patent is hereby corrected as shown below:

TITLE PAGE:

[56] REFERENCES CITED

OTHER PUBLICATIONS

"vol." should read --Vol.--.

COLUMN 1:

Line 17, "of" should rad --of an--;
Line 43, "electropotographic" should read --electrophotographic--;
Line 51, "e.g.," should read --against--;
Line 60, "However" should read --However,--; and
Line 63, "frequency" should read --frequently--.

COLUMN 2:

Line 9, ""FORAFLON", (both Trade Mark)" should read --"FORAFLON" (both trademarked),--;
Line 15, delete "the";
Line 35, "high" should read --highly--; and
Line 47, "may be" should read --is--.

COLUMN 3:

Line 60, "non—fused" should read --non-fused--; and
Line 64, "Other" should read --other--.

UNITED STATES PATENT AND TRADEMARK OFFICE

CERTIFICATE OF CORRECTION

PATENT NO. : 5,589,924

DATED : December 31, 1996

INVENTOR(S) : HIDEYUKI YANO, ET AL.

It is certified that error appears in the above-indentified patent and that said Letters Patent is hereby corrected as shown below:

COLUMN 4:

Line 36, "Ω" should read --Ω cm--;
Line 45, "circumstances" should read --circumstances,--;
Line 54, "changed" should read --charged--; and
Line 58, "jamping" should rad --jumping--.

COLUMN 5:

Line 20, "blade-or" should read --blade or--;
Line 41, "trade mark," should read --trademark,--;
Line 48, "prevented" should read --preventing--; and
Line 66, "(trade mark)" should read --(trademark)--.

COLUMN 6:

Line 13, "occur," should read --occurs,--;
Line 53, "copy'; should read --copy;--; and
Line 64, "further several" should read --several more--.

UNITED STATES PATENT AND TRADEMARK OFFICE

CERTIFICATE OF CORRECTION

PATENT NO. : 5,589,924 Page 3 of 3

DATED : December 31, 1996

INVENTOR(S) : HIDEYUKI YANO, ET AL.

It is certified that error appears in the above-indentified patent and that said Letters Patent is hereby corrected as shown below:

COLUMN 7:

Line 1, "may affect the bad influence" should read --may effect a bad influence--;
Line 44, "in" should read --at--;
Line 54, "("CEFBPN" should read --("CEFBON--; and
Line 55, "trade mark)" should read --trademark)--.

COLUMN 8:

Line 33, delete "and".

COLUMN 10:

Line 13, "A system" should read --An electrophotographic photosensitive system--.

Signed and Sealed this

Eighth Day of July, 1997

Bruce Lehman

*Attest:*

BRUCE LEHMAN

*Attesting Officer*

*Commissioner of Patents and Trademarks*